United States Patent [19]

Smith

[11] Patent Number: 4,818,349

[45] Date of Patent: Apr. 4, 1989

[54] SELECTIVE PLATING APPARATUS FOR ZONE PLATING

[75] Inventor: Mark L. Smith, Harrisburg, Pa.

[73] Assignee: AMP Incorporated, Harrisburg, Pa.

[21] Appl. No.: 150,879

[22] Filed: Feb. 1, 1988

[51] Int. Cl.[4] ..... C25D 5/02; C25D 17/00

[52] U.S. Cl. ..... 204/15; 204/28; 204/206; 204/224 R

[58] Field of Search ..... 204/15, 28, 206, 224 R

[56] References Cited

U.S. PATENT DOCUMENTS

| | | | |
|---|---|---|---|
| 4,405,410 | 9/1983 | Sebastien | 204/15 |
| 4,564,430 | 1/1986 | Bacon et al. | 204/206 |
| 4,595,464 | 6/1986 | Bacon et al. | 204/15 |
| 4,597,045 | 7/1986 | Bacon et al. | 204/206 |
| 4,683,045 | 7/1987 | Murata | 204/206 |
| 4,702,811 | 10/1987 | Murata | 204/206 |

FOREIGN PATENT DOCUMENTS

| | | | |
|---|---|---|---|
| 103389 | 5/1987 | Japan | 204/15 |
| 136586 | 6/1987 | Japan | 204/15 |

OTHER PUBLICATIONS

"Piece Parts Plater", Robbins and Craig, South El Monte, Calif.

"Syncro-Plat III Model B", Robbins and Craig, South El Monte, Calif.

"Syncro-Plat III-Gold Savings Production Prowed", Robbins and Craig, South El Monte, Calif.

"News for Release," Robbins and Craig, South El Monte, Calif.

"Product Literature", Robbins and Craig, South El Monte, Calif.

*Primary Examiner*—T. M. Tufariello

*Attorney, Agent, or Firm*—Katherine A. Nelson

[57] ABSTRACT

A selective plating apparatus (20) for zone plating is comprised of a contained supply (22) of plating solution having an elongated avenue of escape or nozzle (32) and anode means (42) mounted along the length of the avenue of escape (32) at a spaced location therefrom such that the plating solution leaving the supply (22) is charged by the anode means (42). The apparatus (20) further includes means (80, 94) for guiding a workpiece (120) having a zone (128) to be selectively plated through the apparatus (20) such that the zone (128) is proximate the avenue of escape (32), the workpiece (120) comprising a cathode means. The apparatus (20) includes means for maintaining a desired rate of plating solution through the avenue of escape (32) whereby the solution wets the selected zone (128) of the workpiece (120) and deposits a layer of plating in the desired zone (128) on the surface of the workpiece as it passes through the apparatus (20). The apparatus (20) is preferably comprised of two such contained supplies (22, 52) of plating solution having the respective avenues of escape (32, 68) on opposite sides (130, 132) of the workpiece (120) thus depositing plating on the selected zone (128) on both sides of the workpiece simultaneously.

16 Claims, 9 Drawing Sheets

SELECTIVE PLATING APPARATUS FOR ZONE PLATING

FIELD OF THE INVENTION

The present invention relates to selective electroplating of electrical terminals, i.e., electroplating only the electrical contact surfaces of the terminals to the exclusion of other surfaces of the terminals and, in particular, to selectively plating terminals that are attached to a carrier strip.

BACKGROUND OF THE INVENTION

In one method of manufacturing electrical terminals, the terminals are stamped and formed from a metal strip and are attached to a carrier strip. This carrier strip is useful for strip feeding the terminals through successive manufacturing operations. One necessary manufacturing operation involves plating, i.e., electroplating the electrical contact surfaces of the noble metal alloys. These metals are characterized by good electrical conductivity and little or no formation of oxides that reduce the conductivity. Therefore, these metals, when applied as plating, will enhance conductivity of the terminals. The high cost of these metals has necessitated precision deposition on the contact surfaces of the terminals, and not on surfaces of the terminals on which plating is unnecessary.

Apparatus for plating is called a plating cell and includes an electrical anode, an electrical cathode comprised of the strip fed terminals, and a plating solution, i.e., an electrolyte of metal ions. A strip feeding means feeds the strip to a strip guide. The strip guide guides the terminals through a plating zone while the terminals are being plated. The plating solution is fluidic and is placed in contact with the anode and the terminals. The apparatus operates by passing electrical current from the anode through the plating solution to the terminals. The metal ions deposit as metal plating on those terminals surfaces in contact with the plating solution.

One method to achieve selective plating is to mask those areas of a workpiece that are not to be plated with a plating resist. Typically the resist is removed from the workpiece after plating. Another method is to use an apparatus having belts against which the workpiece lies, such that the belts mask the areas to remain unplated. This type of apparatus also requires means for driving the belt or belts along a continuous path through the apparatus in addition to means for moving the workpiece through the apparatus against the belts.

Other means for selectively plating components such as dip plating or tip plating involve passing one end or the other of the contact through the plating solution. These methods are unsatisfactory when the plating zone lies at center of a strip of electrical contacts.

U.S. Pat. Nos. 4,564,430; 4,597,564; and 4,597,845 disclose a continuous contact plating apparatus and method therefore, wherein the apparatus uses a continuously moving brush belt containing plating solution brought into contact against a webbed workpiece which plates selective portions of the continuous webbed workpiece. The belt is continuously replenished with plating solution through a box manifold. The belt is made of open-cell foam or absorbent material which wicks the plating solution and brushes it on the desired area of the cathodically charged web workpiece. The workpiece and brush belt are brought into precise contact at openings in a header of the box manifold where plating takes place.

These patents also teach a guide for the webbed workpiece that is adjustable along more than one axis for contacting the brush belt with the webbed workpiece with a range of contact pressure and angles. The brushed belt of this system is comprised of a continuous loop of material that is a carrier for a continuous loop of absorbent material that in fact is the brush. The carrier and the brush material must both be chemically inert to the plating solution used with the apparatus. Furthermore the brush must be periodically replaced as it wears out.

It is desirable, therefore, to have a selective plating apparatus for continuously plating a strip of electrical contacts or other workpiece that does not require belts, either to plate a selective area or to mask an area that is not to be plated on the workpiece.

SUMMARY OF THE INVENTION

Accordingly, it is an object of the present invention to provide a maskless system for selectively plating a zone of a continuously moving workpiece or strip of material.

It is another object to provide a maskless plating system for plating the center zone of a strip of material.

Another object of the invention is to provide a means for achieving a constant thickness of plating on the selected zone of the material.

It is yet another object to provide a means wherein plating can be applied to both sides of a workpiece simultaneously.

It is also an object of the present invention to provide a maskless system for selective plating a continuous strip of electrical contact members.

Furthermore, it is an object of the invention to provide an apparatus that will apply selective plating along the center of a strip of electrical contact members in a continuous manner.

It is a further object of the invention to provide a system wherein a series of zones can be plated simultaneously on a strip of material and in particular a strip of electrical terminal members.

In the preferred embodiment the apparatus is comprised of a contained supply of plating solution having an elongated avenue of escape or nozzle and anode means mounted along the length of the avenue of escape at a spaced location therefrom such that the plating solution leaving the supply is charged by the anode means. The apparatus further includes means for guiding a workpiece having a zone to be selectively plated through the apparatus such that the zone is proximate the avenue of escape, the workpiece comprising a cathode means. The apparatus includes means for maintaining a desired rate of plating solution through the avenue escape whereby the solution wets the selected zone of the workpiece and deposits a layer of plating in the desired zone on the surface of the workpiece as it passes through the apparatus.

In its preferred embodiment the apparatus is comprised of two such contained supplies of plating solution having the respective avenues of escape on opposite sides of the workpiece thus depositing plating on the selected zone on both sides of the workpiece simultaneously.

The invention itself, together with further objects and its intendant advantages, will best understood by reference to the following detailed description taken in conjunction with the accompanying drawings.

DETAILED DESCRIPTION OF THE DRAWINGS

Figure 1:
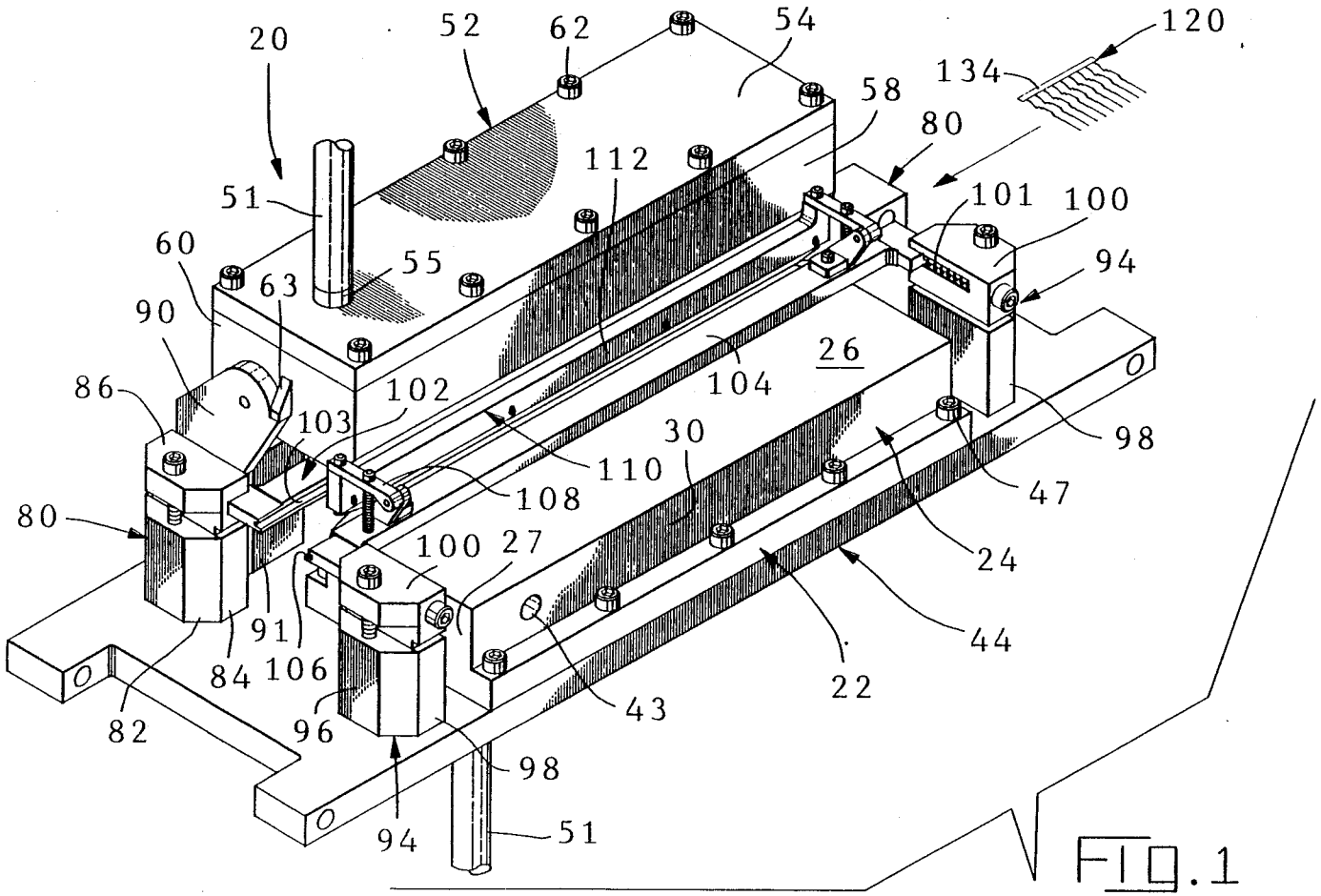
FIG. 1 is a perspective view of the plating apparatus of the present invention.
Figure 2:
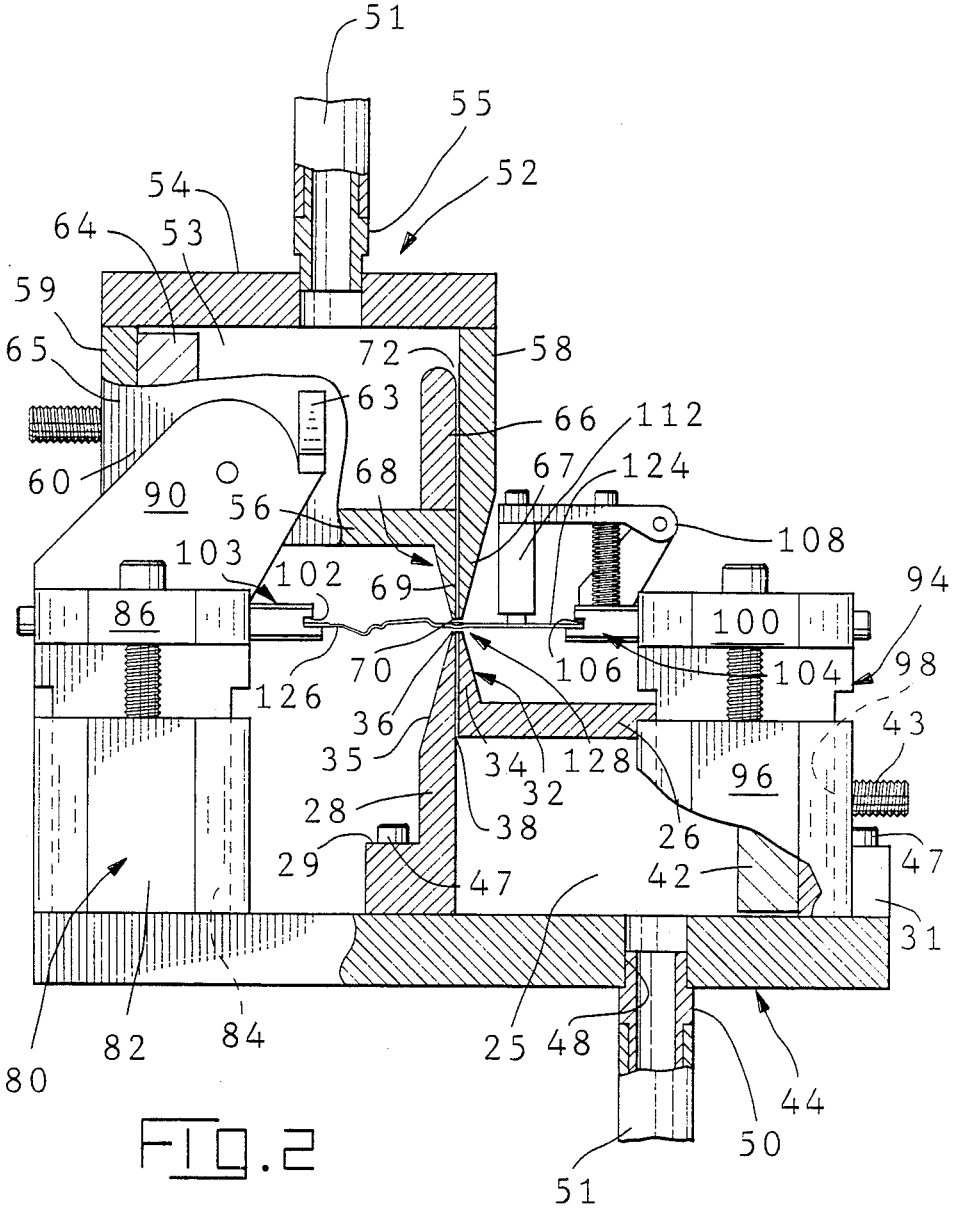
FIG. 2 is a partially cross sectioned end view of the apparatus of FIG. 1.
Figure 3:
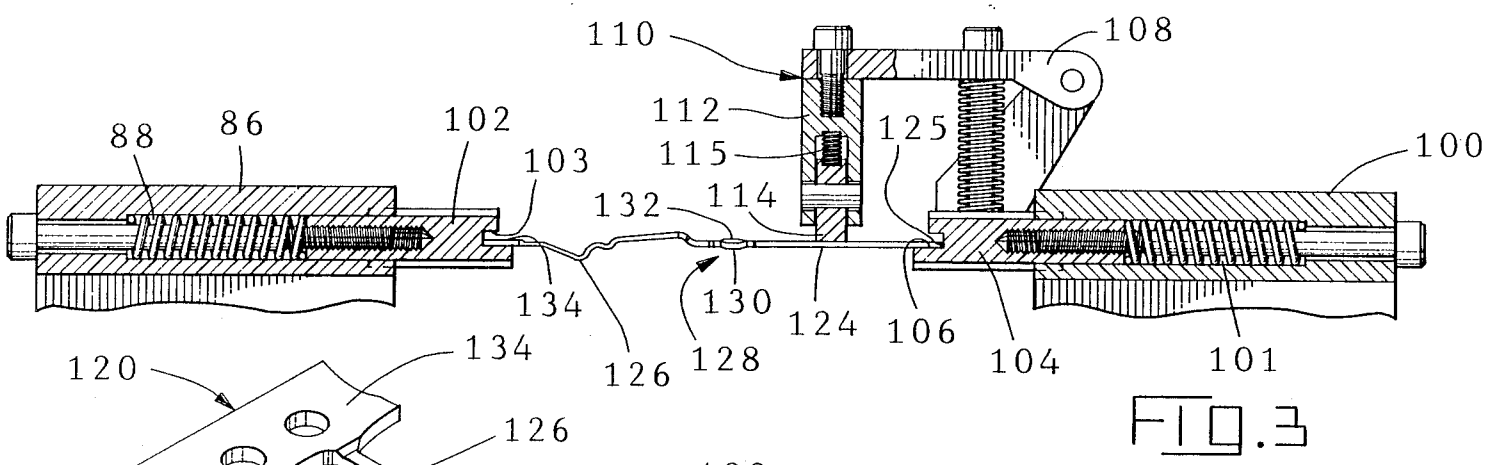
FIG. 3 is an enlarged partially cross sectioned view of the strip guide and support means.
Figure 4:
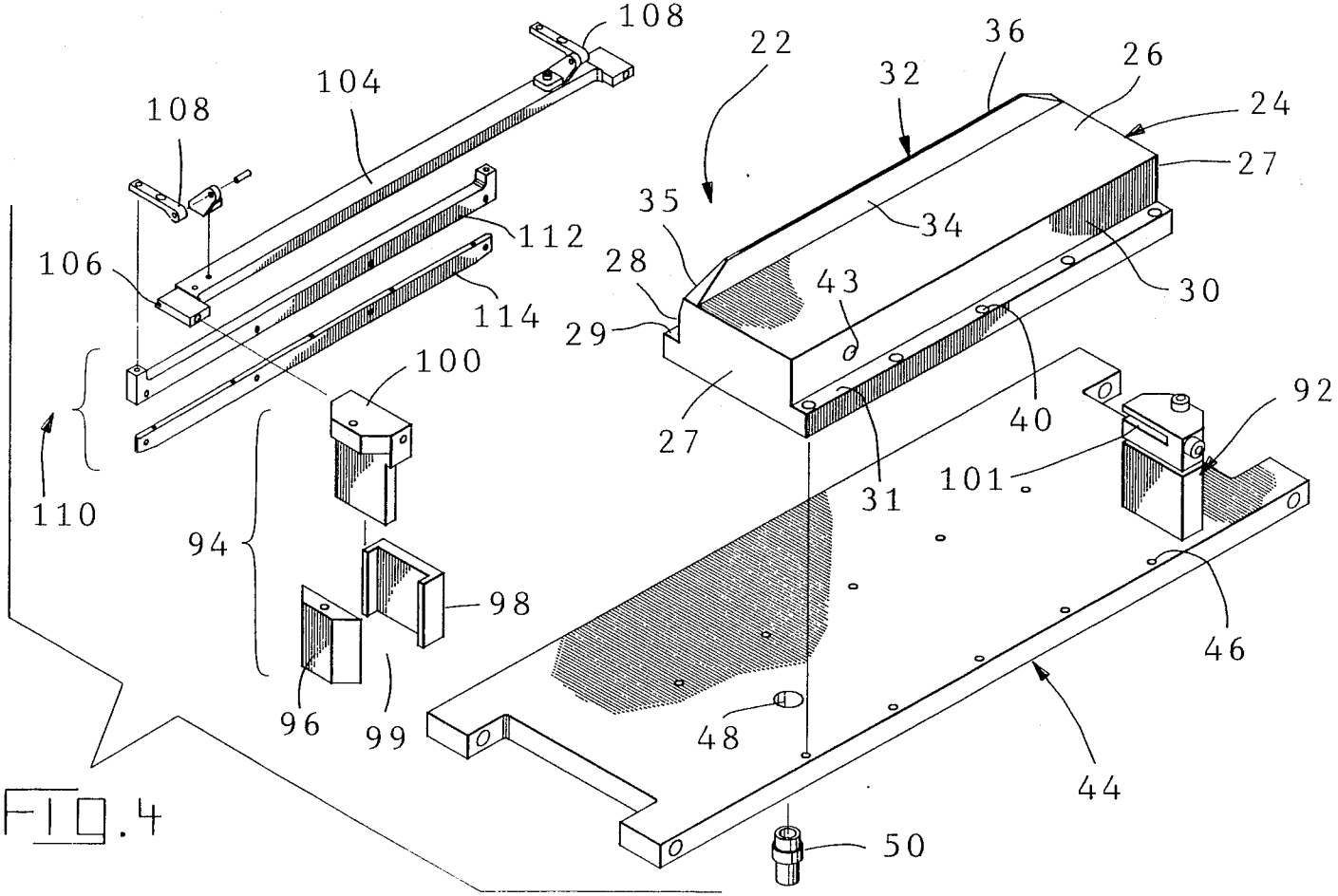
FIG. 4 is an exploded view of the lower box manifold of the present invention.

Referring now to FIGS. 1 through 5, the selective plating apparatus 20 of the present invention is comprised lower manifold 22, upper manifold 52, first and second strip support means 80, 94, and first and second strip guide means 102, 104. As is shown in FIGS. 1, 2 and 4, lower manifold 22 is comprised of body portion 24 mounted to base plate 44. Body portion 24 includes top wall 26, end walls 27, and opposed front and rear walls 28 and 30 having flanges 29, 31 extending outwardly therefrom. Body portion 24 includes cavity 25 formed by the above walls, as best seen in FIG. 2. Flanges 29 and 31 include mounting apertures 40 therein for mouting body portion 24 to base plate 44. Body portion 24 further includes nozzle 32 having sides 34, 35 extending upwardly from top wall 26 and front wall 28 respectively, end face 36 and passageway 38. Nozzle 32 extends essentially the length of walls 26 and 28 and is the means of escape for the plating solution. Anode means 42 is disposed in cavity 25 and extends essentially parallel to nozzle 32. Anode means 42 is mounted along the rear wall 30, as best seen in FIG. 2. Rear wall 30 further has means 43 for connecting electrical current to anode means 42.

Base plate 44 has apertures 45 therein, which are in alignment with apertures 40 in body portion 24. Apertures 40 and 46 receive mounting means 47 therethrough to attach body portion 24 to base plate 44, thus completing the assembly of lower manifold 22. In the embodiment shown, base plate 44 further includes nozzle aperture 48 for receiving inlet nozzle 50. It is to be understood that the nozzle may also enter any of the walls of the cavity. Conduit 51 is attached to the outer end of inlet nozzle 50 and provides plating solution to manifold or chamber 22 from a reservoir, not shown.

Figure 5:
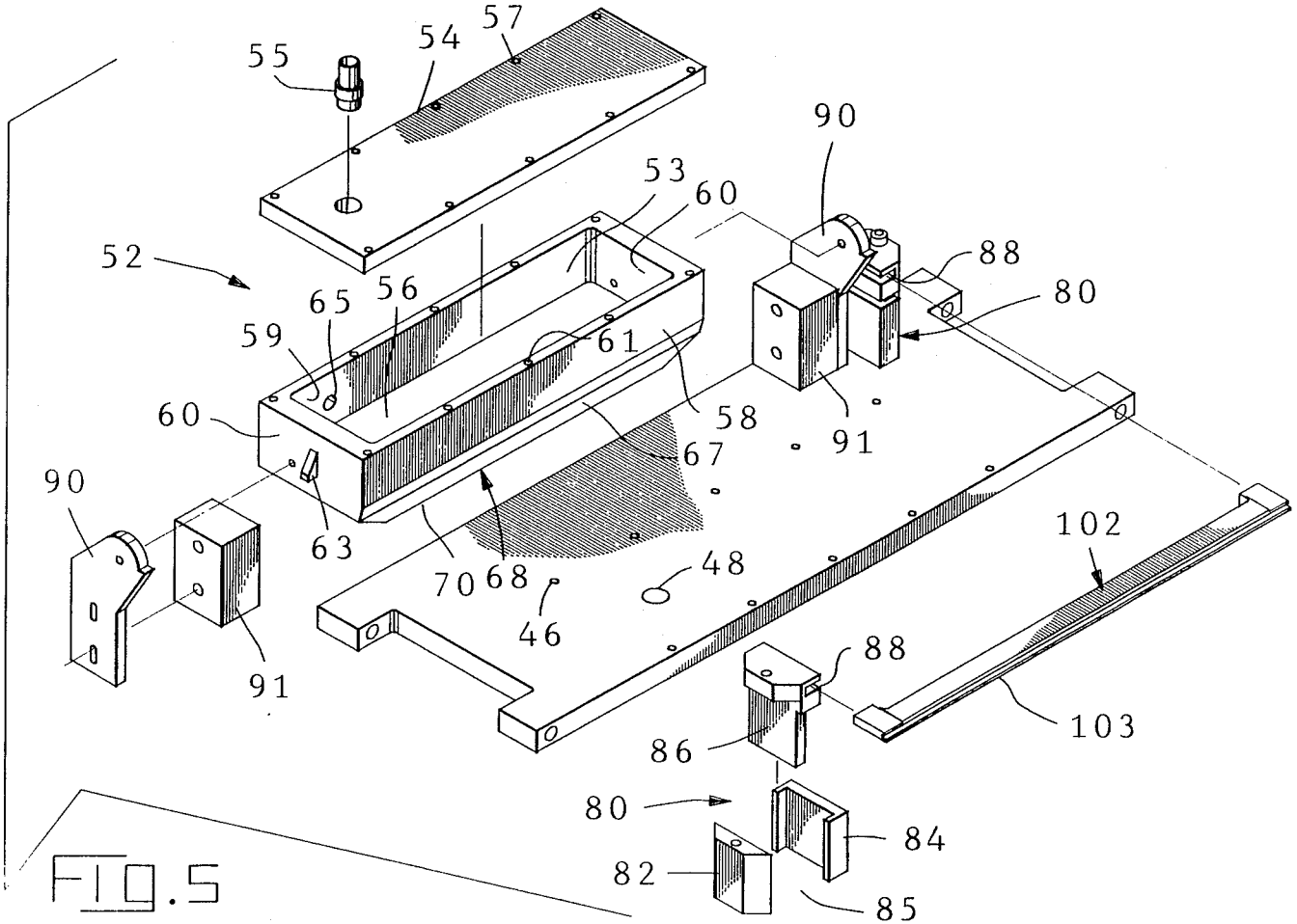
FIG. 5 is an exploded view of the upper box manifold of the present invention.

As can be seen in FIGS. 1, 2 and 5, upper manifold 52 is comprised of top and bottom walls 54, 56, front and rear walls 58, 59, and end walls 60. Upper manifold 52 includes cavity 53 formed by the above walls. Top wall 54 includes inlet nozzle 55 for receiving plating solution into cavity 53. Another conduit 51 is attached to the outer end of inlet nozzle 55 to provide plating solution to the upper manifold from a reservoir, not shown. Top wall 54 includes apertures 57 therein, which are in alignment with apertures 61 in front, rear and end walls 58, 59, 60 respectively and receive mounting means 62 when the upper manifold is assembled. Cavity 53 further includes anode means 64, as best seen in FIG. 2, which extends essentially along the entire length of rear wall 59. Electric current is supplied to anode means 64 at 65. Upper manifold 52 includes nozzle 68 having sides 67, 69 extending downwardly from front wall 58 and bottom wall 56 respectively. Nozzle 68, which extends essentially the length of front and bottom walls, 58, 56 and is the means of escape from the plating solution from upper manifold 52. Nozzle 68 has passageway 72 therein and end face 70. Cavity 53 further includes a baffle plate 66 is alignment with front wall 58 and parallel to nozzle 68. Baffle plate 66 blocks immediate access of the plating solution to nozzle 68, thus providing a means for allowing cavity 53 to be essentially filled with plating solution before the solution exits through nozzle 68.

Preferably, the plating manifolds are formed from polyvinyl chloride or other dielectric material that will withstand the chemicals and temperatures associated with the plating process. The type of anode used is determined by the plating system used in the apparatus.

Figure 6:
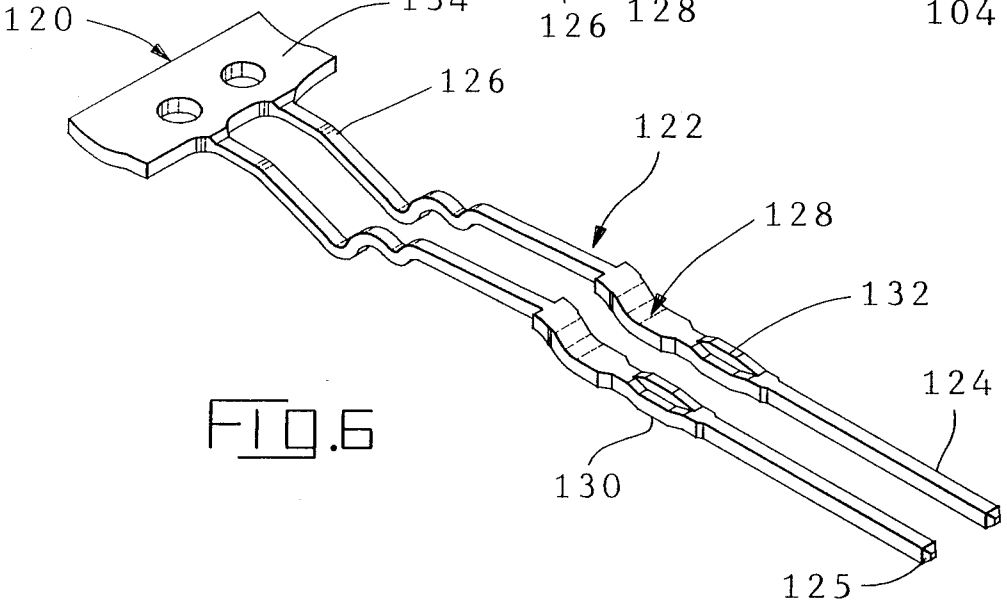
FIG. 6 is a perspective view of a portion of a strip of terminals representing the types of terminals that can be plated in accordance with this invention.

Apparatus 20 is designed to zone plate a workpiece or strip of material that is continuously moved through the apparatus. One example of a workpiece is shown in FIG. 6, which illustrates a partial strip 120 of electrical terminal members 122 having first and second end portions 124, 126 and plating zone 128. Plating zone 128 has opposed lower and upper surfaces, 130 and 132 respectively. Contact terminals 122 extend outwardly from carrier strip 134, which is attached to second terminal end portions 126. It is to be understood that a second carrier strip may also be attached to second end portions 125 of terminals 122 and that electrical terminals 122 are merely representative of the many types of terminals that may be plated with apparatus 20.

In assembled apparatus 20, as best seen in FIGS. 1, 2 and 3, upper and lower manifolds 22, 52 respectively are aligned so that their respective nozzles 32, 68 are on opposed surfaces 132, 130 of plating zone 128 of strip 120 as it passes between nozzles 32 and 68. As is shown in FIGS. 1, 2 and 5, upper manifold 52 is supported in place by pivot arm 90, which is mounted through block 91 to end walls 60 of upper manifold 52 and and to base plate 44 by mounting means, not shown. Pivot arm 90 cooperates with stop means 63 on end wall 60 of upper manifold 52 and holds manifold 52 in position above the strip of material to be plated.

Strip 120 is supported as it travels between the nozzles of apparatus 20 by first and second strip support means 80 and 94 respectively. First strip support means 80 is mounted to base plate 44 adjacent pivot means 91 by mounting means, not shown. Second strip support means 94 is mounted to base plate 44 adjacent end walls 27 of lower manifold 22 by mounting means, not shown. First strip support means 80 includes base member 82, sleeve member 84 and guide member 86. When assembled, base and sleeve members 82, 84 are configured to form a vertical slot 85 for slidably receiving guide member 86. Means are also provided for adjustably locating guide member 86 in slot 85. Guide member 86 includes horizontal slot 88, which extends essentially parallel to support base 44 and receives first strip support means 102 having horizontal slot 103 therein. In the embodiment as shown in FIGS. 1, 2 and 3, slot 103 adjustably receives the edge of carrier strip 134 as strip 120 is moved through apparatus 20. Second strip support means 94 supports the opposite longitudinal edge 125 of end portion 124 of strip 120 and is constructed in a similar manner to first strip support means 80. Second strip support means 94 includes base member 96, sleeve member 98 and guide member 100. When assembled, base and sleeve members 96, 98 are configured to form a vertical slot 99 for slidably receiving guide member 100. Means are also provided for adjustably locating guide member 100 in slot 99. Guide member 100 includes horizontal slot 101, which extends essentially parallel to support base 44 and receives second strip support means 104 having horizontal slot 106 therein. In the embodiment as shown in FIGS. 1, 2 and 3, slot 106 adjustably receives edge 125 of strip 120 it is moved through apparatus 20.

The adjustability of guide members 86, 100 in slots 85, 99 respectively in first and second strip support means 80, 94 provides means for adjusting the vertical relationship of the workpiece or strip of material relative to the position of nozzles 32, 68 of apparatus 20. The adjustability of the position of the longitudinal edges of the strip in slots 103, 106 of first and second strip guide means 102, 104 respectively provides means for adjusting the horizontal relationship of the workpiece or strip of material relative to the position of nozzles 32, 68 of apparatus 20 to bring the selected plating zone in alignment with the nozzles. Apparatus 20, therefore, can be readily and easily adjusted to accept a variety of different types of workpieces and in particular a variety of electrical terminal designs without the need to redesign belts as may be necessary with previously used systems.

As is shown in FIG. 3 and 4, strip guide member 104 further includes arms 108 mounted thereto, which pivotally supports spring loaded member 110. Spring loaded member 110 includes guide 112 having member 114 spring mounted therein with spring members 115. Spring loaded member 114 rests against terminal strip 120 and aids in aligning any terminal members 122 that may be out of the plane of strip 120 as it passes between lower and upper nozzles 32, 68.

When strip 120 of terminals 122 is plated in accordance with the invention, plating material is deposited by apparatus 20 in selected zone 128 of terminals 122. The strip 120 of terminals is mounted so that end portions 124 of terminals 122 and carrier strip 134 are in slots 103, 106 of support plates 102, 104 respectively, and opposed surface areas 130, 132 of plating zone 128 are in alignment with nozzles 32, 68 respectively.

Figure 7:
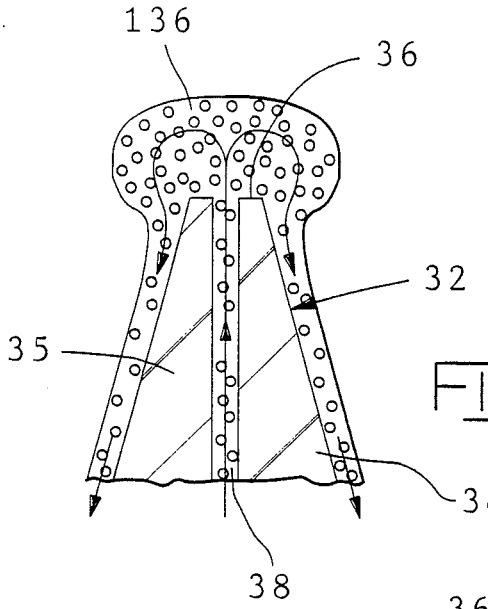
FIG. 7 is a cross sectional view of the nozzle of the lower box manifold, illustrating the pattern of the flow of plating solution through the nozzle.
Figure 8:
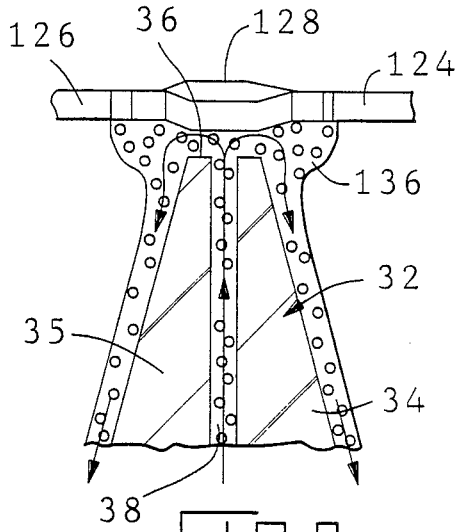
FIG. 8 is a cross sectional view similar to FIG. 7 illustrating the pattern of the flow of plating solution when a contact terminal is aligned with the nozzle.
Figure 9:
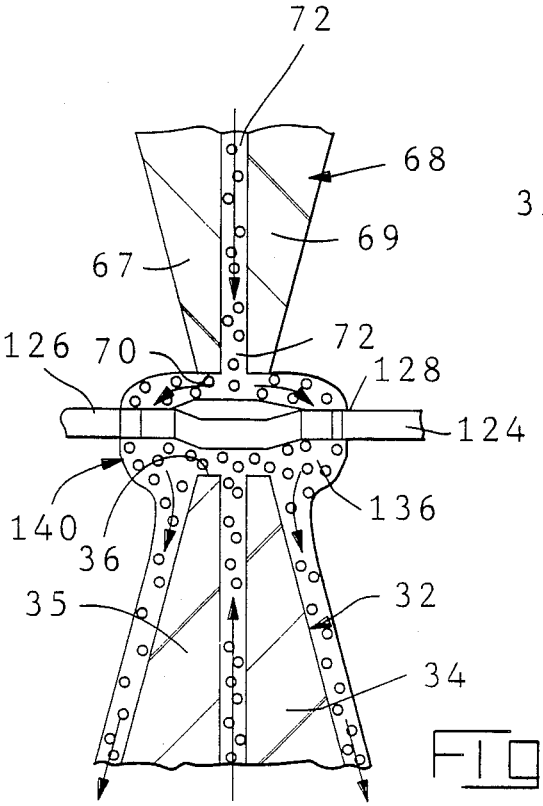
FIG. 9 is a cross sectional view of the nozzles of the upper and lower box manifolds of the assembled apparatus illustrating the pattern of flow of solution as the terminal passes between the nozzles.

FIGS. 7 through 9 illustrate the flow pattern of the plating solution through nozzles 32 and 68 to form plating envelope 140. FIG. 7 shows the plating solution being pumped under pressure upwardly through lower nozzle 32 so that it forms a bubble 136 at end face 36 of lower nozzle 32 and flows downwardly along sides 34, 35 of nozzle 32. FIG. 8 shows the spreading of bubble 136 as it encounters the selected plating zone 128 on electrical terminal 122 as it passes over nozzle 32. Surface tension causes bubble 136 to spread outwardly such that it is approximately three times the width of end face 36 of nozzle 32. FIG. 9 shows the pattern of plating solution as it flows downwardly through nozzle 68 in upper manifold 52 and onto terminal 122 in selected plating zone 128. The rate of flow of plating solution through upper nozzle 68 is adjusted so that the edges of bubble 138 formed by upper nozzle 68 is about again three times the width of end face 70 of nozzle 68.

The rates of flow of the plating solution through nozzles 32, 68 of upper and lower box manifolds or chambers 22, 52 is adjusted so that plating envelope 140 is formed around selected plating zone 128. If the flow rate of the solution through upper nozzle 68 is too great, plating envelope 140 will break and the plating solution will flow outwardly along terminal 122 and out of the plating zone 128. In the embodiment shown in FIGS. 1, 2 and 5, the rate of flow through the upper chamber is controlled by means of baffle 66 which allows the upper plating manifold 52 to essentially be filled before solution flows through nozzle 68. Lower chamber 22 is filled by pumping solution into the chamber under pressure and outwardly through nozzle 32.

Figure 10:
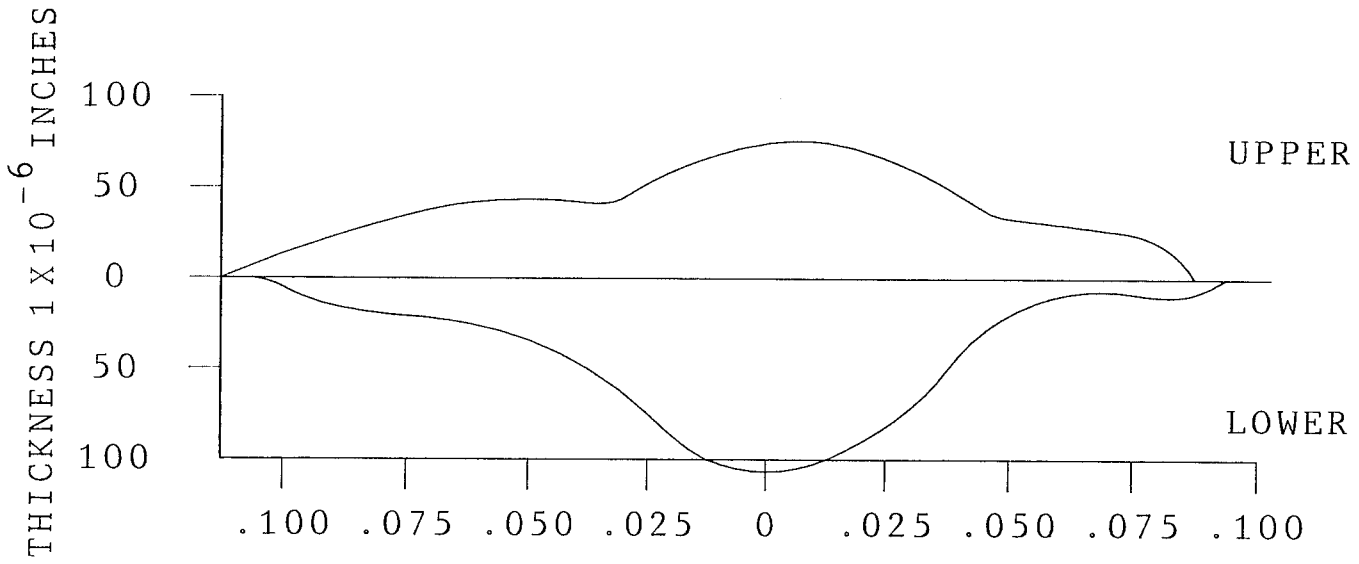
FIG. 10 is a graph illustrating the average distribution and thickness of the plating layer deposited on both sides of a series of electrical terminals plated in accordance with the invention.

FIG. 10 is a graph representing the average thickness of plating throughout the plating zone of a number of electrical terminals of the type shown in FIG. 6. The thickness of the plated zone decreases as you move away from the center of the plating envelope shown as 0. As can be seen from this Figure the thickness of the upper and lower layers in the plating zone is approximately the same.

Figure 11:
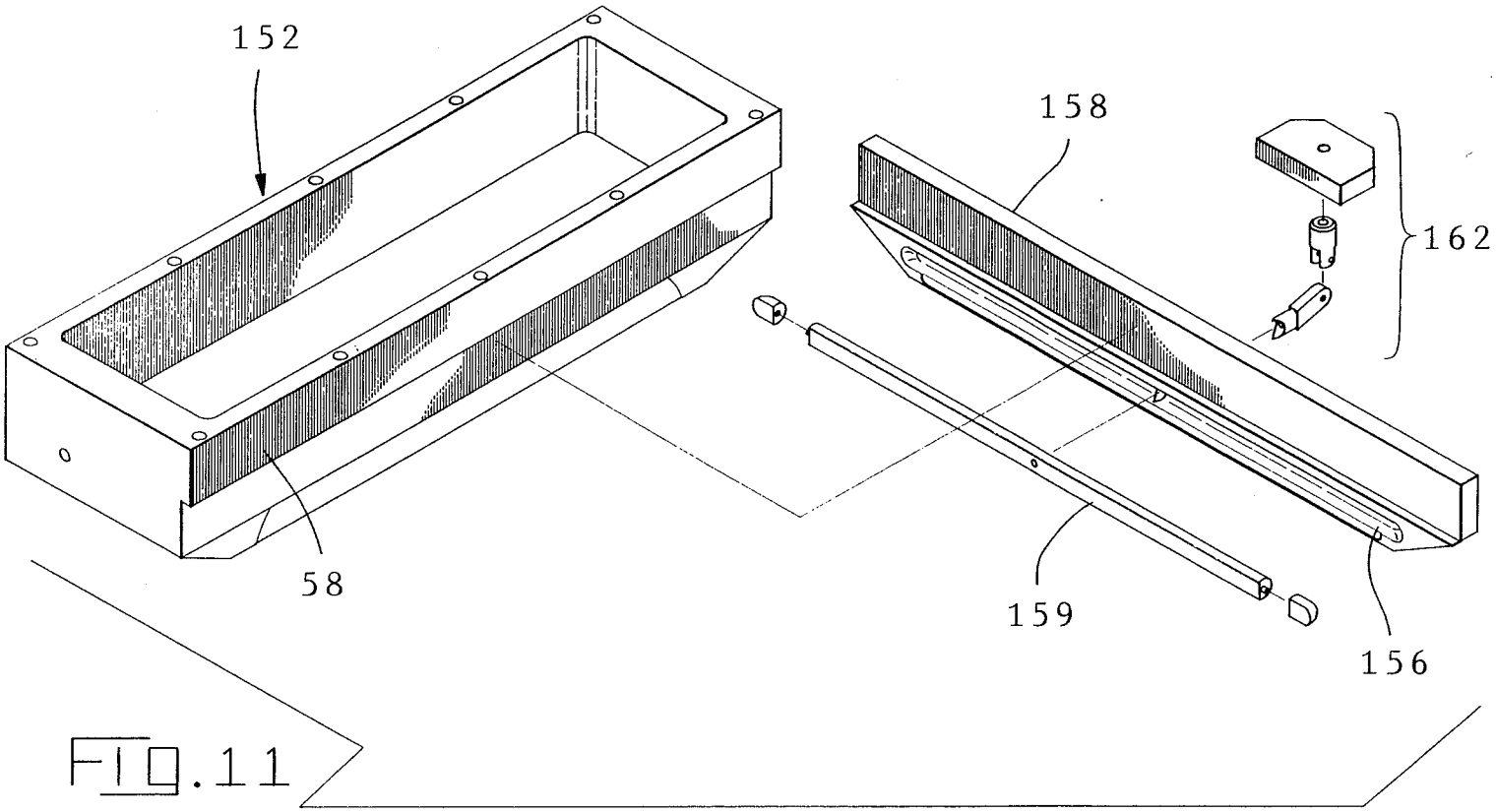
FIG. 11 is an exploded view of an alternative embodiment of the upper box manifold.
Figure 12:
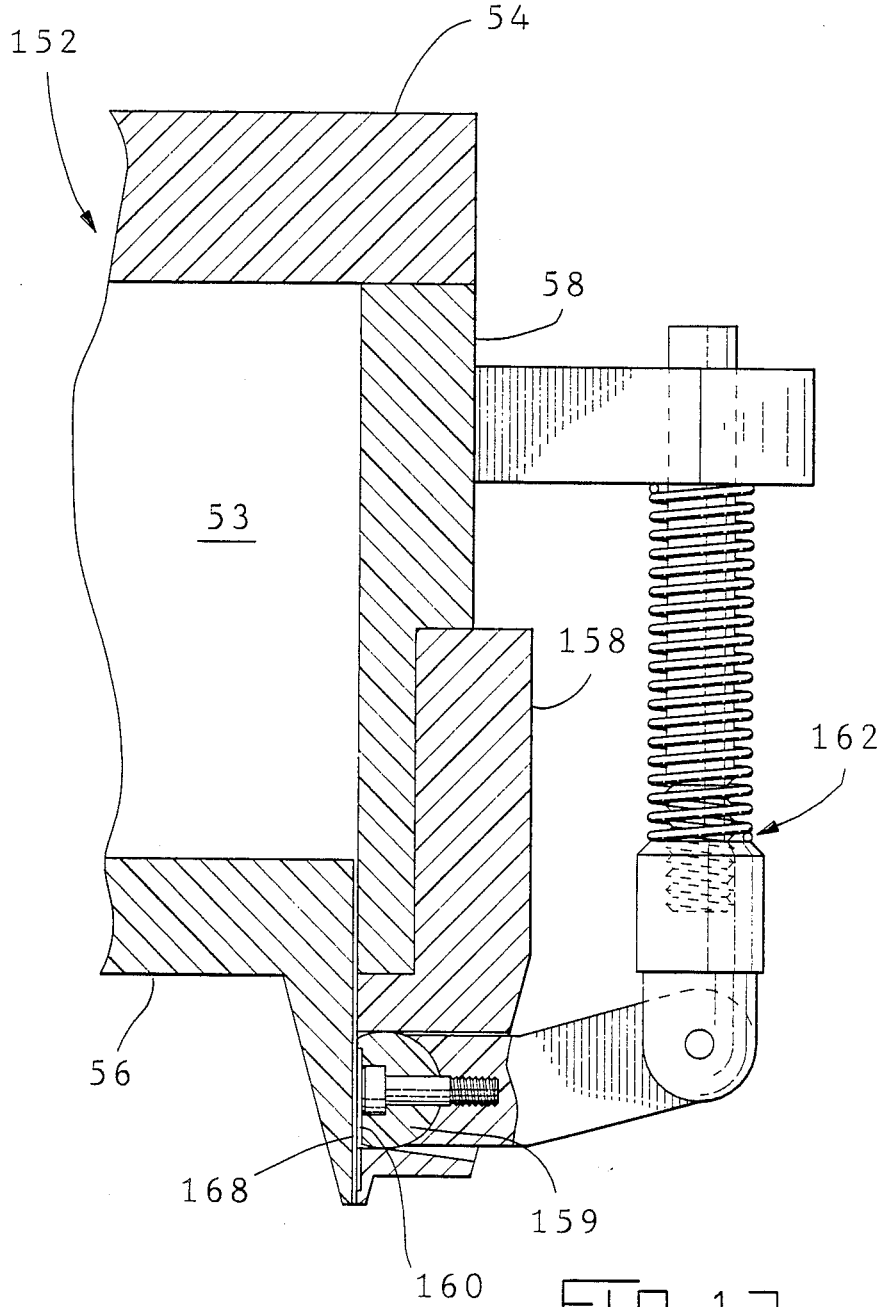
FIG. 12 is a cross sectional view of the nozzle portion of the manifold of FIG. 11.

FIGS. 11 and 12 show an alternative embodiment 152 of the upper manifold wherein front wall 58 is modified to receive block member 158 having valve means mounted therein. Block member 158 is provided with annular slot 156 in which is mounted shaft 159 to form a butterfly valve at 160. The action of the butterfly valve at 160 is controlled through control means 162, which moves the valve inwardly and outwardly to control the flow of the plating solution through nozzle 168.

It has been found that to maintain the plating within the selected zone, the ratio of the rate of flow of solution between upper and lower nozzles should be about three to five. The flow pattern is initially established by adjusting the rate of flow from lower chamber nozzle 32. The flow rate of solution through upper nozzle 68 is adjusted only to the extent necessary to maintain the pattern established by the lower nozzle. The plating envelope is cylindrical in shape and covers the surface. The face of the nozzle stabilizes the edge of the envelope and causes the solution to flow outwardly wetting the end of the nozzle and the part.

To maintain continuity of plating it is necessary that the nozzles be filled at all times. The flow rate through the upper manifold must be sufficient to keep the nozzle full so that there will be an even layer of plating deposited on the surface. Baffle 66 in manifold 52 allows the solution to accumulate to maintain the a full chamber. Butterfly valve 160 in the alternative manifold embodiment 152 increases back pressure against the plating solution, thus enabling the chamber to be filled while allowing the flow rate to be maintained.

In plating with apparatus 20 of this invention, strip 120 is pulled through the apparatus by drive means (not shown). The effective plating length of apparatus 20 is the length of the nozzle of the two box manifolds. By adjusting the flow rate in a proper manner a uniform deposit can be placed on both sides of the material at one time. To obtain an even thickness on both sides of the material the voltage in the respective box manifolds should be maintained the same. A series of apparatii 20 may be used to sequentially plate a series of thin layers or a series of different plating zones. Alternatively, it is possible to plate on just one side of a strip by using the lower manifold only.

Apparatus 20 is compact and one or more can be mounted in a standard plating trough, thus making it easily to add to existing plating lines. Plating troughs or tanks are known in the art and are readily available from commercial sources. There is no need to redesign a plating line to provide floor space for a large piece of equipment, which is usually required by a belt apparatus.

Depending on the composition of the plating bath used and its "throwing power" the anode used in the apparatus may be soluble or insoluble. "Throwing power," as known in the art, is a measure of the extent to which a plating solution will produce deposits that are more uniform than those that would be produced in the absence of any effects which reduce high current densities. See *The Canning Handbook on Electroplating,* W. Canning Limited, Birmingham, 1978, 22 ed. p 578–579.

When using a soluble anode, the size of the chamber should be large enough to accommodate an anode member and enough plating solution so that the anode will dissolve uniformly. To minimize down time for maintaining the apparatus and replacing anode members, the chamber should also be large enough to accommodate a sufficiently large anode member. The box manifolds or chambers can be smaller when insoluble anode members are used. The composition of the plating bath determines the type of anode required. Typically this information is supplied by the manufacturer of the bath or is available in the literature describing plating bath compositions. Plating solutions for plating silver, gold, nickel, tin and other metals can be plated with use of this apparatus.

It is to be understood that the electrical terminals used with the present device are representative samples only. It can be appreciated that the length and sides of the nozzle can be adjusted to modify the width of the plating zone. Since the plating envelope formed by the nozzle is about three time the width of the end face of the nozzle a narrower or wider zone can be plated by changing the width of sides of the nozzles. The flow rate through the nozzles in the two manifolds can be adjusted accordingly to form the plating envelope, previously described, thus the passageway may remain the same size. While the width of the nozzles governs the width of the plating zone, the width of the nozzles does not govern the geometry of the parts to be plated. Since the parts move through the apparatus horizontally, the plating envelope can be formed around a wide variety of terminal configurations. There is no need to retool a specifically contoured nozzle for different terminal designs. This apparatus, therefore, provides for great flexibility in plating than is possible with belt designs which generally move the parts through vertically and often require contoured belts to achieve the desired plating.

It can be appreciated that the present invention is a maskless system that enables selective plating along a desired zone of contact terminals in a continuous manner. It can also be appreciated that a plurality of zones can be plated simultaneously or sequentially by passing the strip of terminals between a plurality of nozzles. The apparatus is relatively compact and has fewer parts than zone plating equipment previously available. Furthermore, since the only continuously moving part is the strip of terminals, parts for driving belts and the like are not necessary.

It is thought that the plating device of the present invention and in many of its attendant advantages will be understood from the foregoing description it will be apparent that various changes may be made in the form, construction and arrangement of the parts thereof without departing from the spirit or scope of the invention or sacrificing all the material advantages. The form herein described is merely a preferred or exemplary embodiment thereof.

What is claimed is:

1. A selective plating apparatus for continuously plating a selected zone on a workpiece, said zone being intermediate the longitudinal edges of said workpiece, comprising:

a contained supply of plating solution having an elongated avenue of escape, said avenue of escape being proximate the plating zone of said workpiece;

anode means mounted along the length of said avenue of escape and at a spaced location therefrom such that all the plating solution leaving the supply has been charged by said anode means;

means for guiding a continuous strip of said workpiece with said zone to be selectively plated through said apparatus, said workpiece being oriented in a generally horizontal plane as said workpiece is moved through said apparatus, said guiding means being adapted to guide said workpiece such that said selected zone is proximate said avenue of escape, said strip comprising cathode means; and means for maintaining a desired flow rate of plating solution through said avenue of escape, whereby said solution wets the selected zone of said workpiece and deposits a layer of plating in the selected zone on the surface of said workpiece as it passes through said apparatus.

2. The selective plating apparatus as described in claim 1 wherein said selected plating zone is located on both opposed surfaces of said workpiece and said apparatus further comprises:

another contained supply of plating solution having an elongated avenue of escape, said avenue of escape being proximate the opposed surface of said selected plating zone of said workpiece, said another supply further having another anode means mounted along the length of said avenue of escape of said another contained supply and at a spaced location therefrom such that all the plating solution leaving the another supply has been charged by said another anode means;

said means for guiding said workpiece with said zone to be selectively plated through said apparatus includes means for guiding said opposed surfaces between said avenues of escape from respective contained supplies of plating solution, and said means for maintaining a desired flow rate of plating solution includes means for maintaining the flow rate through said another avenue of escape, whereby said solution wets the opposed surfaces of the selected zone of said workpiece and deposits a layer of plating in the selected zone on the surfaces of said workpiece as it passes through said apparatus.

3. The selective plating apparatus as described in claim 1 wherein said anode means is a soluble anode member.

4. The selective plating apparatus as described in claim 1 wherein said anode means is an insoluble anode member.

5. The selective plating apparatus as described in claim 2 wherein said anode means in said contained supplies are soluble anode members.

6. The selective plating apparatus as described in claim 2 wherein said anode means in said contained supplies are insoluble anode members.

7. The selective plating apparatus as described in claim 1 wherein said selected zone of plating is selectively plated without the need of masking said workpiece.

8. The selective plating apparatus as described in claim 1 wherein said workpiece is a strip of electrical terminals and said selected zone is a contact zone of said terminals.

9. The selective plating apparatus as described in claim 1 wherein said at least one selected plating zone is located on both opposed surfaces of said workpiece and said apparatus further comprises:

another contained supply of plating solution having an elongated avenue of escape, said avenue of escape being proximate the opposed surface of said plating zone of said workpiece, said another supply further having another anode means mounted along the length of said avenue of escape of said another contained supply and at a spaced location therefrom such that all the plating solution leaving the another supply has been charged by said another anode means;

said means for guiding said workpiece with said at least one zone to be selectively plated through said apparatus includes means for guiding said opposed surfaces between said avenues of escape from respective contained supplies of plating solution, and said means for maintaining a desired flow rate of plating solution includes means for maintaining the flow rate through said another avenue of escape, whereby said solution wets the opposed surfaces of the at least one selected zone of said workpiece and deposits a layer of plating in the at least one selected zone on the surfaces of said workpiece as it passes through said apparatus.

10. A method for continuously plating a selected zone on a workpiece, said zone being intermediate the longitudinal edges of said workpiece, comprising the steps of:

providing a contained supply of plating solution having an elongated avenue of escape, said avenue of escape being proximate the plating zone of said workpiece, said contained supply including anode means mounted along the length of said avenue of escape and at a spaced location therefrom such that all the plating solution leaving the supply has been charged by said anode means;

guiding a continuous strip of said workpiece with said zone to be selectively plated through said apparatus, said workpiece being oriented in a generally horizontal plane as said workpiece is moved through said apparatus, said guiding means being adapted to guide said workpiece such that said selected zone is proximate said avenue of escape, said strip comprising cathode means; and maintaining a desired flow rate of plating solution through said avenue of escape, whereby said solution wets the selected zone of said workpiece and deposits a layer of plating in the selected zone on the surface of said workpiece as it passes through said apparatus.

11. The method of continuously plating a selected zone on a workpiece as described in claim 10 wherein said selected zone is located on both opposed surfaces of said workpiece and wherein the method further includes the step of providing another contained supply of plating solution having an elongated avenue of escape, said avenue of escape being proximate the selected plating zone of said workpiece, said another contained supply including anode means mounted along the length of said avenue of escape and at a spaced location therefrom such that all the plating solution leaving the another supply has been charged by said anode means.

12. The method of continuously plating a zone on a workpiece as described in claim 11 wherein said workpiece is guided between the avenues of escape of said contained supply of plating solution and said another contained supply of plating solution.

13. The method of continuously plating a zone on a workpiece as described in claim 10 wherein said workpiece is a strip of electrical terminals and said selected zone is a contact area of said terminals.

14. A selective plating apparatus for continuously plating at least one selected zone on a workpiece, said at least one zone being intermediate the longitudinal edges of said workpiece, comprising:

at least one contained supply of plating solution, each supply having an elongated avenue of escape, said avenue of escape being proximate a respective one of said at least one plating zone of said workpiece;

anode means mounted along the length of said avenue of escape and at a spaced location therefrom such that all the plating solution leaving the supply has been charged by said anode means;

means for guiding a continuous strip of said workpiece with said at least one zone to be selectively plated through said apparatus, said workpiece being oriented in a generally horizontal plane as said workpiece is moved through said apparatus, said guiding means being adaptable to guide said workpiece such that each said at least one selected zone is proximate a respective said avenue of escape, said strip comprising cathode means; and means for maintaining a desired flow rate of plating solution through each said avenue of escape, whereby said solution wets the at least one selected zone of said workpiece and deposits a layer of plating in the selected zone on the surface of said workpiece as it passes through said apparatus.

15. The selective plating apparatus as described in claim 14 wherein said at least one selected zone of plating is selectively plated without the need of masking said workpiece.

16. The selective plating apparatus as described in claim 14 wherein said workpiece is a strip of electrical terminals and said at least one selected zone is a contact area of said terminals

* * * * *